US009711071B2

(12) United States Patent
Chakravartula et al.

(10) Patent No.: US 9,711,071 B2
(45) Date of Patent: Jul. 18, 2017

(54) RECREATING NATURAL WATER MOVEMENT IN VISUAL ART

(71) Applicant: Floetic LLC, Santa Clara, CA (US)

(72) Inventors: Arun Kumar Nallani Chakravartula, Los Gatos, CA (US); Karthik Subramanian Colinjivadi, San Jose, CA (US)

(73) Assignee: FLOETIC LLC, Santa Clara, CA (US)

( * ) Notice: Subject to any disclaimer, the term of this patent is extended or adjusted under 35 U.S.C. 154(b) by 93 days.

(21) Appl. No.: 14/793,221

(22) Filed: Jul. 7, 2015

(65) Prior Publication Data

US 2017/0011672 A1 Jan. 12, 2017

(51) Int. Cl.

| | |
|---|---|
| ***G09F 19/12*** | (2006.01) |
| ***G09F 13/00*** | (2006.01) |
| ***G09F 27/00*** | (2006.01) |
| ***G09F 13/24*** | (2006.01) |

(52) U.S. Cl.
CPC ..... *G09F 19/12* (2013.01); *G09F 13/00* (2013.01); *G09F 13/24* (2013.01); *G09F 27/00* (2013.01)

(58) Field of Classification Search
CPC ..... G09F 19/12; A47G 1/12
See application file for complete search history.

(56) References Cited

U.S. PATENT DOCUMENTS 636,319 A * 11/1899 Camp ..... B32B 17/06 273/155
1,458,208 A * 6/1923 Houghton ..... G09F 13/24 40/406
2,623,312 A * 12/1952 Kee ..... G09F 13/24 40/406
4,160,427 A * 7/1979 Holbrook ..... A01K 63/006 119/254
4,353,327 A * 10/1982 Shroyer ..... A01K 63/003 119/257
4,944,969 A * 7/1990 Usui ..... B44C 3/025 40/409
5,819,452 A * 10/1998 Hakkert ..... G09F 13/12 40/219
6,119,382 A * 9/2000 Hakkert ..... G09F 13/24 40/406

(Continued)

*Primary Examiner* — Gary C Hoge
(74) *Attorney, Agent, or Firm* — Lowenstein Sandler LLP

(57) ABSTRACT

A visual art piece comprises a plurality of transparent sheets, wherein at least one of the plurality of transparent sheets comprises cutouts forming an upper reservoir, a lower reservoir and a channel between the upper reservoir and the lower reservoir, wherein the cutouts are filled with a first liquid and a second liquid. The visual art piece also includes a plurality of scenery image layers depicting a natural scene, each of the plurality of scenery image layers comprising a portion of the natural scene at a different visual depth, wherein each of the plurality of scenery image layers is affixed between two of the plurality of transparent sheets. The visual art piece further includes a pump coupled to the at least one of the plurality of transparent sheets, the pump to propel the second liquid from the lower reservoir to the upper reservoir when activated, the second liquid to flow through the first liquid in the channel from the upper reservoir to the lower reservoir to visually simulate natural water movement in the natural scene.

14 Claims, 4 Drawing Sheets

(56) References Cited

U.S. PATENT DOCUMENTS

| | | | | |
|---|---|---|---|---|
| 6,149,991 | A * | 11/2000 | Okuda | A01K 63/006 119/245 |
| 6,203,394 | B1 * | 3/2001 | Lee | G09F 19/02 40/406 |
| 6,883,722 | B2 * | 4/2005 | Pankow | A61M 21/00 239/17 |
| 7,922,103 | B2 * | 4/2011 | Houstoun | B05B 17/085 239/17 |
| 2006/0064908 | A1 * | 3/2006 | Weinstein | G09F 13/24 40/406 |
| 2011/0252677 | A1 * | 10/2011 | Beebe | G09F 13/18 40/406 |
| 2013/0276479 | A1 * | 10/2013 | Noyes | A44C 17/0283 63/28 |

* cited by examiner

RECREATING NATURAL WATER MOVEMENT IN VISUAL ART

TECHNICAL FIELD

This disclosure relates to the field of microfluidics, and in particular to creation of a thin-profile visual art system comprising to-scale natural sceneries with dynamic natural water movement.

BACKGROUND

Natural scenery, such as the visual and auditory aspects of dynamic water movement (e.g., waterfalls, fountains, streams, waves, rain, snow, etc.), has long been a fascination for the human mind. It is well established that exposure to such natural scenery can bring wellbeing and happiness to all. Access to such scenery is limited, however, as natural sceneries may be geographically distant, physically difficult to access and may only be available for a short time annually due to seasonal variations.

A popular way to enjoy natural scenery on a daily basis is to replicate it, such as in the form of wall posters or framed pictures for display in the home, in offices or in other public or private locations. While these replications successfully capture the static aspects of the natural scenery, they fail to capture the dynamic aspects. Videos can capture some dynamic aspects of the natural scenery within their capability, however, the display of a video may not always be a practical replacement for a wall-hanging visual art piece due to cost, power and weight limitations.

BRIEF DESCRIPTION OF THE DRAWINGS

Embodiments of the present invention will be understood more fully from the detailed description given below and from the accompanying drawings, which, however, should not be taken to limit the present invention to the specific embodiments, but are for explanation and understanding only.

DETAILED DESCRIPTION

Figure 1:
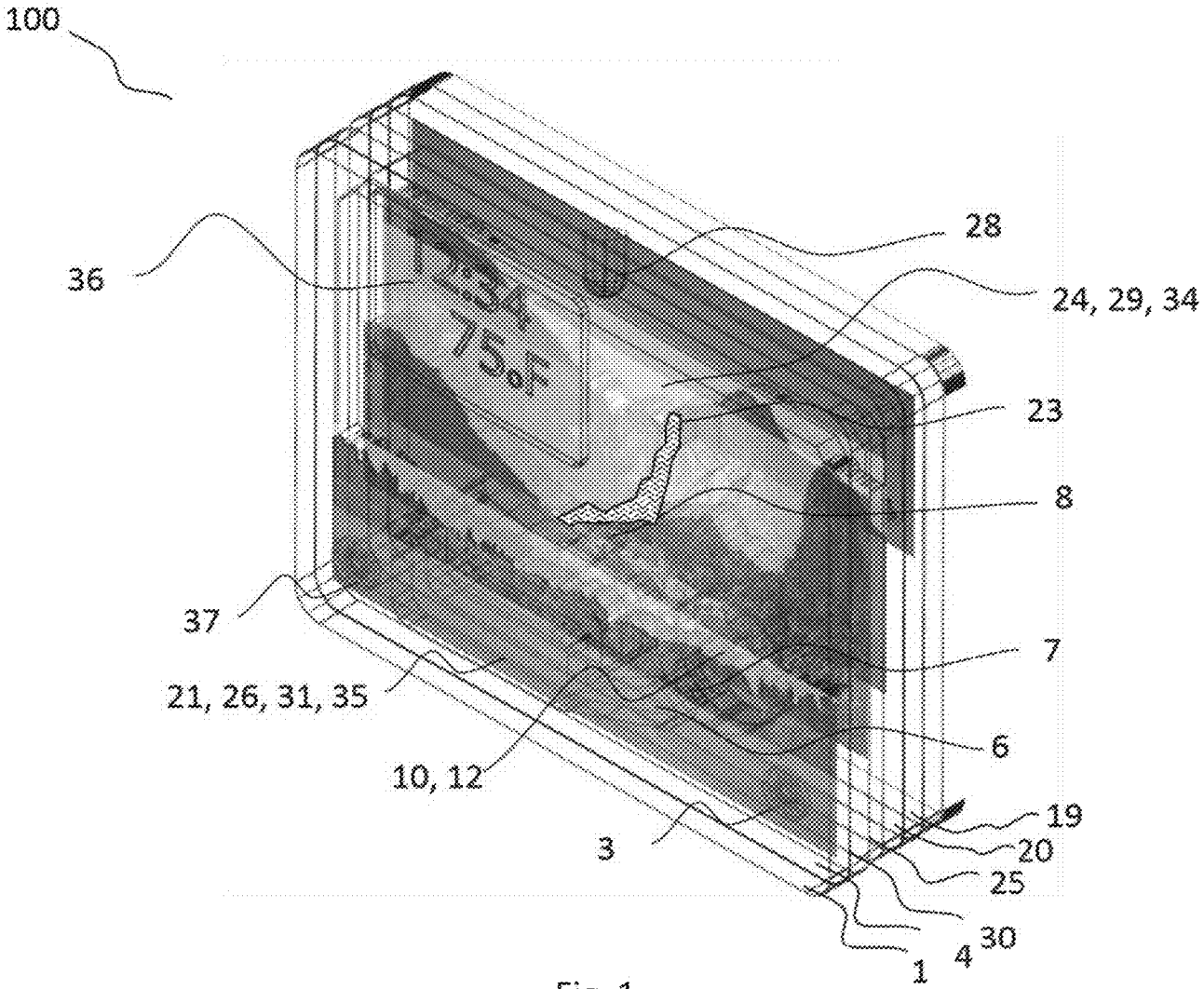
FIG. 1 is a diagram illustrating a visual art piece for recreating natural water movement, according to an embodiment.

Embodiments of an apparatus are described for a thin-profile visual art system that recreates to-scale natural sceneries with dynamic natural water movement. In one embodiment, a visual art piece is formed through lamination of multiple layers of transparent material with embedded layers of printed natural scenery, reservoirs, channels, pumps, mixers and two or more immiscible liquids to recreate to-scale natural scenery with dynamic water movement. The result is a thin-profile visual art piece, suitable for hanging on a wall or other display that will overcome the shortcomings of previous attempted solutions. The visual art piece may be displayed in any number of locations, including private or government offices, corporate centers, on billboards, in automobiles, public places such as parks, trains, buses, airplanes, rail stations, bus stops, airports, museums, etc. Many attempts at depicting dynamic water movement fail to accurately reproduce dynamic water movement in natural scenery. For example, certain products utilize a blue patterned paper rolling behind a lighted natural scenery in a painting or photograph. The fixed outline and rigid non-random movement, however, fails as a recreation of natural water movement. Other products utilize actual water movement but come with a high cost of establishment and maintenance, a requirement for dedicated facilities, and a bulky size. In addition, the dynamic water movement of the smaller scale replica in these products is not comparable to that in larger natural sceneries. This failure can be attributed to the difference in nature of fluid properties at micro and macro scales. At a macro scale, such as that found in nature, liquids have very low surface to volume ratio, resulting in the bulk properties of the liquid dominating the flow. At smaller scales, however, such as those found in a visual art piece, the surface to volume ratio of liquids tends to be higher, causing the surface properties of the liquid to dominate over the volume properties. This creates a significant visual difference in dynamic water movement in larger natural settings (e.g., Yosemite Falls, with an approximate 2400 foot water drop) and smaller replicas.

In one embodiment, a visual art piece comprises a plurality of transparent sheets, wherein at least one of the plurality of transparent sheets comprises cutouts forming an upper reservoir, a lower reservoir and a channel between the upper reservoir and the lower reservoir, wherein the cutouts are filled with a first liquid and a second liquid. The visual art piece also includes a plurality of scenery image layers depicting a natural scene, each of the plurality of scenery image layers comprising a portion of the natural scene at a different visual depth, wherein each of the plurality of scenery image layers is affixed between two of the plurality of transparent sheets. The visual art piece further includes a pump coupled to at least one of the plurality of transparent sheets, the pump to propel the second liquid from the lower reservoir to the upper reservoir when activated, the second liquid to flow through the first liquid in the upper reservoir to the lower reservoir to visually simulate natural water movement in the natural scene.

In one embodiment, the visual art piece includes a closed loop feedback control system based on flow sensors, DC motor pumps/mixers and a microcontroller or other control circuitry to maintain a consistent relative movement between the two liquids over time. The visual art piece may additionally include electrical circuitry, a display panel, speakers and LED lights that create sounds and lighting effects corresponding to the depicted natural scene. In one embodiment, the systems within the visual art piece run on low voltage electricity of less than 5V at low power of less than 100 mW and can be powered by batteries, a 5.0 V direct DC power supply, a solar panel or some other power source.

FIG. 1 is a diagram illustrating a visual art piece for recreating natural water movement, according to an embodiment. In one embodiment, visual art piece 100 includes a laminated stack of optically transparent sheets 1, 4, 30, 25, 20 and 19 and a number of scenery image layers that form the basic structure of the visual art piece 100. In one embodiment, the transparent sheets are formed from acrylic glass or some other sturdy, break-resistant and substantially transparent material. In one embodiment, one or more of the optically transparent sheets 1, 4, 30, 25, 20 and 19 have areas of material cut out or through, allowing formation of an upper reservoir represented by cutouts 24, 29 and 34, a lower reservoir represented by cutouts 21, 26, 31 and 35, multiple channels represented by cutouts 6 and 8, a via represented by cutout 7 and a pump chamber represented by cutouts 10 and 12. The cutouts allow storage and circulation of a first liquid and a second liquid which are used to simulate natural water movement, such as a waterfall 23 in a natural scene depicted by the scenery image layers, as will be described in more detail below. In certain embodiments, the transparent sheets may include additional cutouts to accommodate control circuitry, speakers 3 and 37, a light 28 and a display panel 36. In one embodiment, the front and the rear most transparent sheets 1 and 19 may not have any cutouts in them. The stack of optically transparent sheets 1, 4, 30, 25, 20 and 19 may be laminated, glued, or otherwise affixed, attached or secured together in order to seal the first liquid, the second liquid and the scenery image layers within the thin-profile visual art piece 100. In one embodiment, the lamination process is done in such a way so as to decrease the visibility of the joints between the transparent sheets.

Figure 2:
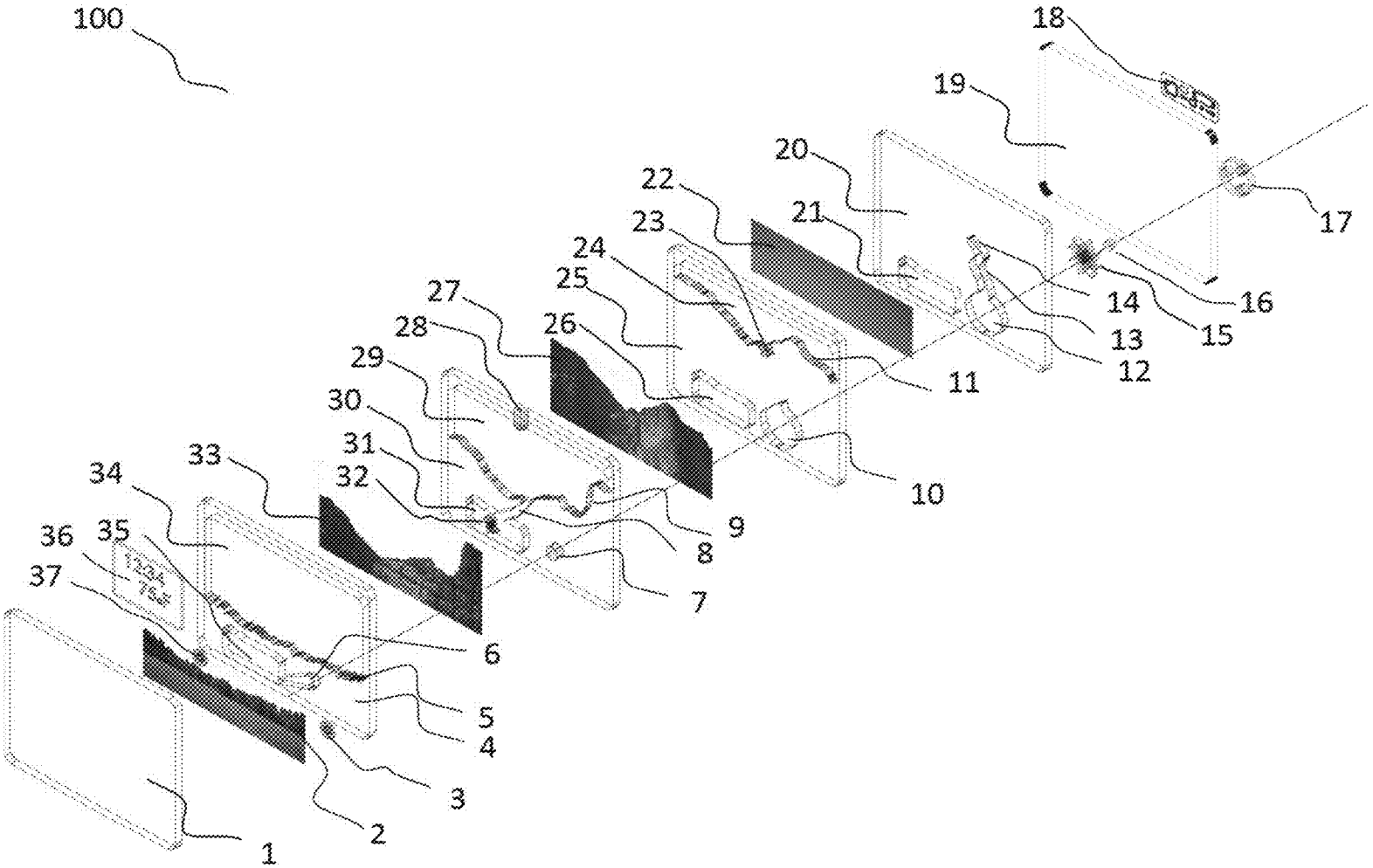
FIG. 2 is a diagram illustrating an exploded view of a visual art piece for recreating natural water movement, according to an embodiment.

FIG. 2 is a diagram illustrating an exploded view of a visual art piece for recreating natural water movement, according to an embodiment. In this diagram, the elements of visual art piece 100, including transparent sheets 1, 4, 30, 25, 20 and 19 and scenery image layers 2, 33, 27 and 22, have been expanded for ease of illustration. It would be understood by one of skill in the art that in the final product and during operation, the elements would be assembled together as illustrated in FIG. 1.

In one embodiment, the scenery image layers 2, 33, 27 and 22 are made in order to give a pseudo-three dimensional perspective to the natural scene depicted in visual art piece 100. In one embodiment, a two dimensional image of the natural scene is edited, for example using an image processing software, into layers 2, 33, 27 and 22. Each layer may include a portion of the natural scene at a different visual depth as viewed from a viewpoint. The layers may be chosen such that the aspects of the natural scene that are the closest to the viewpoint are depicted in the front image layer 2 and aspects of the natural scene that are the farthest from the viewpoint are depicted in the back layer 22 of the visual art 100. Other intermediate aspects of the natural scenery are depicted in the image layers 33 and 27, which are arranged between the front image layer 2 and the back image layer 22.

In one embodiment, each of the scenery image layers is affixed between two of the transparent sheets. For example, image layer 2 is between transparent sheets 1 and 4, image layer 33 is between transparent sheets 4 and 30, image layer 27 is between transparent sheets 30 and 25, and image layer 22 is between transparent sheets 25 and 20. In one embodiment, in order to minimize or reduce any visual distortion of the natural scene caused by the cutouts in the transparent sheets, the cutouts align with an edge of the scenery image layer adjacent to the corresponding transparent sheet. For example, in transparent sheet 4, the cut line 5 for the cutout 34 representing the upper reservoir aligns with the top edge of scenery image layer 2. Similarly in transparent sheet 30, the cut line 9 for the cutout 29 representing the upper reservoir aligns with the top edge of scenery image layer 33 and in transparent sheet 25, the cut line 11 for the cutout 24 representing the upper reservoir aligns with the top edge of scenery image layer 27.

In one embodiment, channel 13 is cut in transparent sheet 20 to route the second liquid from the pump chamber 10, 12 to the top 14 of the waterfall 23. From the top of waterfall 23 in the upper reservoir, the second liquid flows through the first liquid to visually simulate natural water movement in the natural scene. Channel 8 is cut in transparent sheet 30 to route the second liquid from the bottom of waterfall 23 into the lower reservoir represented by cutouts 21, 26, 31 and 35. In one embodiment, channel 6 is cut in transparent sheet 4 to route the second liquid from the lower reservoir back into the pump chamber 10 and 12 for recirculation by pump 15 and 17.

As described above, the ratio of the surface area of a liquid to the volume of the liquid can influence the behavior of the liquid when flowing. For example, in a natural waterfall where the volume of water flowing is relatively high compared to the surface area of the water in contact with the air through which the water is flowing, the water will behave in a certain way. When the volume is reduced, however, to a size appropriate for an in-home, wall-hanging visual art piece, the ratio between volume and surface area is changed significantly, thereby altering the behavior of the water. As a result, the lower volume of water may not visually simulate the natural water movement very accurately. In order to account for this change, in one embodiment, the visual art piece 100 utilizes a plurality of liquids, including the first liquid and the second liquid for recreating dynamic water movement on a significantly smaller scale.

In one embodiment, a pump consisting of an electric DC motor outer pump wheel 17, impellor 15 and a drive mechanism is designed with an objective of incorporating the entire pump within the thin profile art piece 100. In one embodiment, the DC motor turns the outer pump wheel 17, which in-turn activates impellor 15 through the use of magnetic coupling through at least one of the transparent sheets (e.g., sheet 19). Depending on the embodiment, the DC motor can either be mounted away from the outer pump wheel 17 and coupled by a rubber drive belt or directly mounted on the outer pump wheel 17. The magnetic coupling between the outer pump wheel 17 and impellor 15 is achieved by concentrically mounting outer pump wheel 17 and impellor 15 on a shaft 16 and mounting matched location magnets within the outer pump wheel 17 and impellor 15. In one embodiment, the magnets may be Neodymium magnets or some other type of magnets. The shaft 16 may be mounted such that it renders the complete seal provided by back transparent sheet 19 intact. In one embodiment, the pump sucks in the second liquid from lower reservoir 21, 26, 31, 35 through the channel 6 and via 7 pushes out liquid to the top of the water fall 14, 23 via the channel 13. In one embodiment, pump 15, 17 functions as a mixer to mix the various constituents of the second liquid within pump chamber 10, 12. For example, the second liquid (which represents the flowing liquid in the visual scene), may be a mixture of two or more constituents (i.e., different liquids). In addition, the second liquid may optionally include the addition of microbeads (i.e., solid particles) within the flowing second liquid in order to achieving a desired thixotropy. In order to improve the visual appearance of the second liquid flowing through the first liquid and to more accurately approximate the natural scene depicted, pump 15, 17 may mix the various constituents of the second liquid, including multiple liquids and/or solid particles, within pump chamber 10, 12 to create a near uniform or homogeneous solution. In another embodiment, a separate dedicated mixing chamber (not shown) may be used to mix the constituents of the second liquid. This mixing chamber may be at least partially filled with porous material, such as a sponge or plastic mesh, and can be used specifically for mixing the constituents of the second liquid.

In one embodiment, a flow sensor 32 is incorporated in the lower reservoir 21, 26, 31, 35 to monitor the flow rate of the second liquid in waterfall 23. This may be achieved by incorporating a freely moving wheel, mounted with a magnet (e.g., a Neodymium magnet), in the flow path of waterfall 23 within the upper reservoir. In one embodiment, a sensor, such as a Hall effect sensor, tracks the rotation speed of the wheel and determines the flow rate of the second liquid within the thin profile art piece 100.

In one embodiment, control circuitry 18 helps manage all of the electrical functions in the thin profile art piece 100. For example, control circuitry 18 helps regulate the flow rate of the second liquid in waterfall 23 by using the signal from the Hall Effect sensor as feedback to control the DC motor voltage in the pump. In one embodiment, control circuitry 18 may also add a random DC voltage ripple to the DC motor creating random flow fluctuations in the visual art piece 100. These random flow fluctuations may more accurately visually approximate natural water movement. Beyond the basic control of the liquid flow, control circuitry 18 has numerous other functions. For example, control circuitry 18 may also control the illumination of lights 28 in the thin profile art piece 100, and may provide audio to supplement the visual art by routing audio signals to the speakers 3 and 37. In one embodiment, control circuitry may also manage the power input for visual art piece 100 by switching between external power supply and an onboard battery (not shown), and may control what information (e.g., time and temperature) is displayed on the front mounted LCD display panel 36.

Since framed visual art piece 100 may be typically used to adorn living rooms or other publicly exhibited areas, sound and lighting effects may be used to enhance the visual and cognitive appeal of the visual art piece 100. For example, the speakers 3 and 37 may be used to play recorded sounds of actual waterfalls which can be heard in the background when liquid is flowing in the art piece 100. Different natural waterfalls have different sounds based on their speed, water volume, rock formation, etc. In one embodiment, control circuit 18 may provide options for a selection of either random combinations of the natural sounds or specific sounds based on the mood. In another embodiment, rather than playing natural waterfall sounds, an option can also be provided to play songs or music instead.

A combination of one or more lights 28 may be used for different lighting options to enhance the visual effect created by the art piece 100. These lights 28 may be implemented using lasers, light emitting diodes (LEDs), incandescent lights, or other types of lights, located either within or surrounding the waterfall 23 in the visual scene. In one embodiment, control circuitry 18 may automatically adjust the lighting in art piece 100 based on the time of the day. In another embodiment, suitable light sensors may be incorporated into art piece 100, which could be used to adjust the lighting. One mesmerizing aspect seen in many natural waterfalls is the occasional visual appearance of a rainbow that occurs as a result of the light scattered through the water spray. Lights 28 may be used to introduce a similar visual effect in art piece 100.

In order to avoid a monotonous look from visual art piece 100 when being displayed in the same place over time, visual art piece 100 may be partially modular, such that the liquid cutouts and channels remain the same, but the surrounding scenery can be changed by inserting different templates for scenery image layers 2, 33, 27 and 22. Such templates could be used to change the ambient scenery based on the season, (e.g., fall, winter, spring, summer). For example, the user may replace one or more of the scenery image layers depicting the original natural scene with different layers depicting a different natural scene or depicting the same natural scene during a different season. To achieve this effect, the laminated stack of transparent sheets may be engineered such that the replacement of these templates can be done easily by any end-user without affecting the aqueous, electrical, and mechanical aspects of the visual art. In one embodiment, a personalized template can be used where a user can print and add their own pictures/art/images of waterfalls or other natural scenes, to give the visual art piece 100 a more personal feel.

Figure 3:
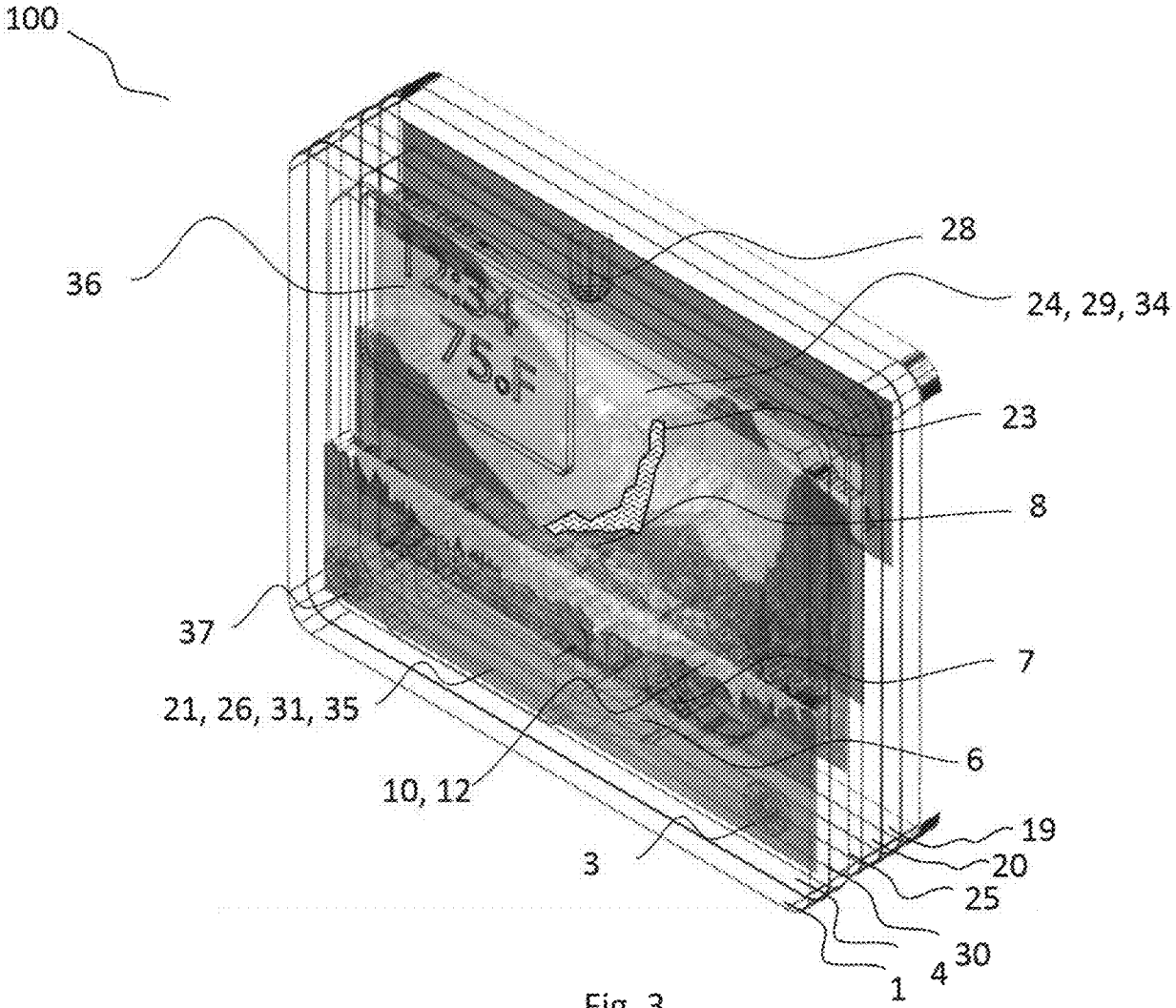
FIG. 3 is a diagram illustrating a visual art piece for recreating natural water movement of a waterfall, according to an embodiment.

FIG. 3 is a diagram illustrating a visual art piece 100 for recreating natural water movement of a waterfall 23, according to an embodiment. In one embodiment, the second liquid flows through the first liquid in the visual scene to form waterfall 23. In one embodiment, the first liquid represents the atmosphere in the visual scene depicted in the art piece 100, while the second liquid represents the flowing liquid in the visual scene. Thus, the first liquid may be a replacement for the air in nature, and the second liquid is a replacement for the natural water (e.g., a waterfall). In one embodiment, the first liquid and the second liquid are filled into the upper reservoir 24, 29 and 34, lower reservoir 21, 26, 31 and 35, channels 6, 8 and 13, via 7 and pump chamber 10 and 12 in such a manner that together, the liquids fill up the corresponding cutouts completely with little or no trapped air remaining. This improves the visual characteristics of the natural scene depicted in art piece 100.

In one embodiment, the first liquid and the second liquid are chosen to be immiscible liquids to cause the liquids to remain separate over time. In another embodiment, the first liquid and the second liquid are at least partially immiscible or have a relatively low level of miscibility. In one embodiment, the first liquid is non-polar (i.e., hydrophobic) and the second liquid is polar (i.e., hydrophilic). As long one liquid is polar and the other is non-polar, they will be immiscible (i.e., will not form a homogeneous mixture when added together). The immiscibility can be observed in one of several ways, depending on the densities of the liquids. If the polar and non-polar liquids have different densities, at a steady state, they may settle one on top of each other, with the more dense liquid settling at the bottom. If the densities of the polar and non-polar liquids are the same, or if the solutions are agitated, the liquid with the higher surface tension may form droplets and float around within the liquid having a lower surface tension. The size of the droplets may depend on the difference in the surface tensions between the two liquids, with smaller drops resulting from a larger difference in surface tension. The first liquid may also be chosen to be less dense than the second liquid to allow the second liquid to flow down through the first liquid and to cause, when visual art piece 100 is upright and not in use (i.e., the first liquid and the second liquid are still with no pumping action), the first liquid to float atop the second liquid. In addition, in one embodiment, the first liquid is chosen to be completely, nearly or substantially transparent in order to form the atmosphere and the second liquid is chosen to be at least partially, substantially or completely opaque in order to provide a visual contrast with the first liquid. For example, the second liquid may have a shade of blue, white or some other color in order to form the flowing water in the visual art piece 100. In certain embodiments, the first liquid may be a mineral oil, such as paraffinic oil, naphthenic oil, or aromatic oil, a paraffin lamp oil, or some combination of these or other liquids. In certain embodiments, the second liquid may be milk, optionally including salt or baking powder as an anticoagulant, glycerin, water, titanium di-oxide coated white polyethylene microspheres (e.g., having a 200 micrometer diameter and 1.25 grams/centimeter$^3$ density), a liquid detergent, such as a mixture of water, ethoxylated alcohol, sodium citrate, tetrasodium N,N-bis (carboxymethyl)-L-glutamate, sodium carbonate, and citric acid, or some combination of these or other liquids. In other embodiments, the first and second liquids may include other liquids not specifically disclosed herein but adhering to the physical and chemical properties described above.

In one embodiment, volume ratio of the first liquid to the second liquid is preferably chosen such that, when visual art piece 100 is upright and not in use, the first liquid fills a majority of the space in the cutouts of visual art piece 100, including upper reservoir 24, 29 and 34, channels 8 and 13, via 7 and parts of pump chamber 10 and 12 and lower reservoir 21, 26, 31 and 35, while the second liquid fills residual portions of lower reservoir 21, 26, 31 and 35 and pump chamber 10 and 12. In one embodiment, the second liquid has a volume of approximately 0.5% to 3% of the volume of the first liquid in the visual art piece. In other embodiments, the first and second liquids may be used in different relative volume amounts. In addition, in one embodiment, the first liquid may have a refractive index that is equal to or approximately equal to that of the material used to form transparent sheets 1, 4, 30, 25, 20 and 19. The refractive index describes how light propagates through the material. By having the refractive indices of the transparent sheets and the first liquid be approximately equal, light passing from one of the transparent sheets to the first liquid or vice versa will have minimal refraction, resulting in less distortion as seen by the viewer. In addition, the glue or lamination materials that secure the transparent sheets together may have the same refractive index as the transparent sheets and the first liquid. As a result, the pseudo-three dimensional perspective provided by scenery image layers 2, 33, 27 and 22 will appear more natural. In addition, the cut lines 5, 9, 11 for the cutouts and the edges of scenery image layers 2, 33, 27 and 22 will be less visible to the viewer.

Beyond density, miscibility, color and transparency, there are other physical properties of the first liquid and the second liquid that may be taken into consideration in order to render to-scale dynamic water movement in visual art piece 100. These properties include, for example, viscosity, surface tension and thixotropy. In one embodiment, the second liquid has a relatively high viscosity, which may be for example, greater than 0.5 Pascal-seconds (Pa·s), while the first liquid has a relatively low viscosity, which may be for example, less than 0.05 Pa·s. The difference in relative viscosities between the first liquid and the second liquid helps promote a uniform flow velocity of the second liquid, regardless of the channel size within the thin-profile art piece 100.

In one embodiment, the surface tensions of the first liquid and the second liquid are chosen to improve how the flow of the second liquid through the first liquid visually resembles a natural waterfall. For example, in one embodiment, the first liquid may have a relative surface tension of approximately 34.5 milliNewtons/meter (mN/m) at 25° Celsius (C) against air. The second liquid may have a relative surface tension of approximately 50 mN/m at 25° C. against air. In other embodiments, the first and second liquids may have other relative surface tension values, but the difference between the surface tensions of the first liquid and the second liquid may be approximately 10 to 25 mN/m at 25° C. against air. If the difference in surface tensions between the first liquid and the second liquid is too high, the second liquid will flow in the form of large drops. Conversely, if the difference in surface tensions between the first liquid and the second liquid is too low, the second liquid will tend towards laminar flow (i.e., in a straight line), and will lack the random flow patterns seen in a natural large-scale waterfall.

Thixotropy is a time-dependent shear thinning property of liquids that measure how much they thin (i.e., experience a reduction in viscosity) over time when shaken, agitated or otherwise stressed. An ideal thixotropic liquid exhibits a step change in viscosity when exposed to a step change in agitation and maintains that viscosity only as long as the agitation persists. In reality, however, most liquids continue to become less viscous under continued agitation. Accordingly, thixotropy may be taken into account when designing the liquid system of art piece 100 in order to produce a consistent flow over the lifetime of the product. In one embodiment, the first liquid and the second liquid should show perfect or near-perfect thixotropic behavior. The addition of microbeads (i.e., solid particles) within the flowing second liquid is one way of achieving the desired thixotropy. In one embodiment, the solid particles are not individually visible to the naked eye, but together prevent the viscosity of the second liquid from decreasing over time when the second liquid is agitated. The solid particles may have the same or slightly higher density, color and transparency as the second liquid and may be hydrophilic, meaning that they will have a tendency to mix with, dissolve in or be wetted by water. In one embodiment, microbeads are formed from a polymer material doped with Titanium dioxide to get a white color and slightly higher density (e.g., approximately 10% higher) than the second liquid. In another embodiment, the pump may be programmed to shut down for a fixed duration regularly to give the first and second liquids a chance to regain original viscosity. For example, the control circuitry 18 may program pump 15, 17 to turn off for one hour, two hours, or some other period each day, every other day, twice a week, etc. Any residual viscosity drift during that time can be adjusted by actively monitoring the flow rate and adjusting the motor speed.

Figure 4:
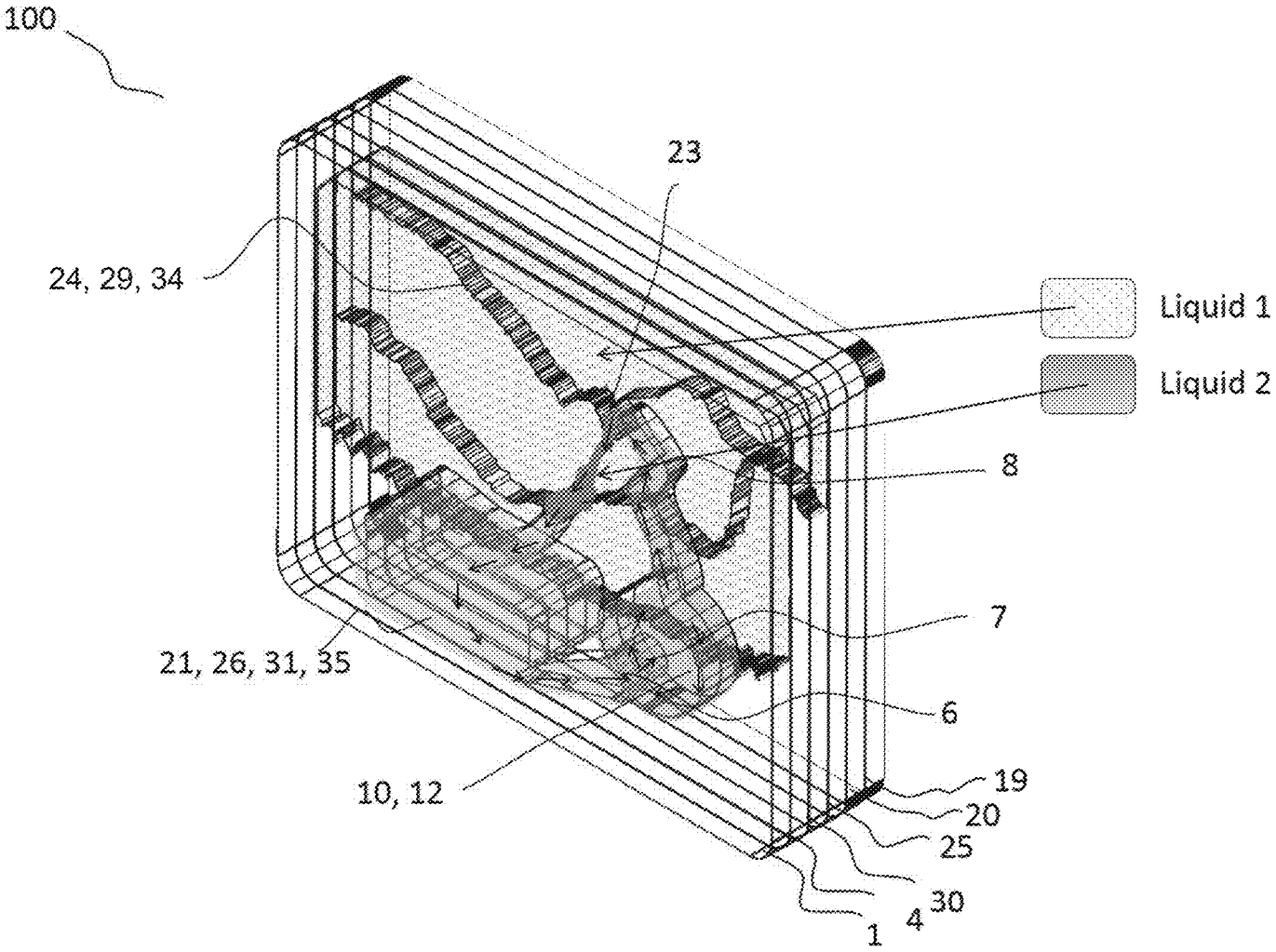
FIG. 4 is a diagram illustrating liquid flow in a visual art piece to recreate natural water movement, according to an embodiment.

FIG. 4 is a diagram illustrating liquid flow in a visual art piece to recreate natural water movement, according to an embodiment. In one embodiment, the pump propels the second liquid from the pump chamber 10, 12 to the top of the waterfall 23 in the upper reservoir 24, 29 and 34. From the top of waterfall 23 in the upper reservoir, the second liquid flows through the first liquid to visually simulate natural water movement in the natural scene. In one embodiment, the first liquid (i.e., Liquid 1) represents the atmosphere in the visual scene depicted in the art piece 100, while the second liquid (i.e., Liquid 2) represents the flowing liquid in the visual scene. The second liquid flows from the bottom of waterfall 23 into the lower reservoir 21, 26, 31 and 35 through channel 8 and is eventually routed from the lower reservoir back into the pump chamber 10, 12 through channel 6 for recirculation by the pump. In one embodiment, the first liquid fills a majority of the space in the cutouts of visual art piece 100, including upper reservoir 24, 29 and 34, channel 8, via 7 and parts of pump chamber 10 and 12 and lower reservoir 21, 26, 31 and 35, while the second liquid fills residual portions of lower reservoir 21, 26, 31 and 35 and pump chamber 10 and 12 as well as flows through the first liquid to form waterfall 23 in upper reservoir 24, 29 and 34.

The foregoing description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the scope of embodiments of the present invention.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. A visual art piece comprising:

a plurality of transparent sheets, wherein at least one of the plurality of transparent sheets comprises cutouts forming an upper reservoir, a lower reservoir and a channel between the lower reservoir and the upper reservoir, wherein the cutouts are filled with a first liquid and a second liquid;

a plurality of scenery image layers depicting a natural scene, each of the plurality of scenery image layers comprising a portion of the natural scene at a different visual depth, wherein each of the plurality of scenery image layers is affixed between two of the plurality of transparent sheets; and a pump coupled to the at least one of the plurality of transparent sheets, the pump to propel the second liquid from the lower reservoir to the upper reservoir through the channel when activated, the second liquid to flow through the first liquid in the upper reservoir to the lower reservoir to visually simulate natural water movement in the natural scene.

2. The visual art piece of claim 1, wherein the plurality of transparent sheets are laminated together to seal the first liquid, the second liquid and the plurality of scenery image layers within the visual art piece.

3. The visual art piece of claim 1, wherein the cutouts in the at least one of the plurality of transparent sheets align with an edge of one of the plurality of scenery image layers adjacent to the at least one of the plurality of transparent sheets.

4. The visual art piece of claim 1, wherein a density of the second liquid is higher than a density of the first liquid.

5. The visual art piece of claim 1, wherein the first liquid and the second liquid are immiscible.

6. The visual art piece of claim 1, wherein the first liquid is substantially transparent and wherein the second liquid is more opaque than the first liquid.

7. The visual art piece of claim 1, wherein a viscosity of the second liquid is higher than a viscosity of the first liquid.

8. The visual art piece of claim 7, wherein the second liquid comprises a plurality of solid particles mixed throughout, wherein the plurality of solid particles are not individually visible to the naked eye, the plurality of solid particles to prevent the viscosity of the second liquid from decreasing over time when the second liquid is agitated.

9. The visual art piece of claim 1, wherein a difference between a surface tension of the first liquid and a surface tension of the second liquid is approximately 10 to 25 milliNewtons/meter at 25° Celsius against air.

10. The visual art piece of claim 1, wherein a refractive index of the plurality of transparent sheets is approximately equal to a refractive index of the first liquid.

11. The visual art piece of claim 1, further comprising:

a flow sensor to measure a rate at which the second liquid flows through the first liquid in the upper reservoir;

control circuitry coupled to the pump, the control circuitry to receive an indication of the rate from the flow sensor and to adjust a rate at which the pump propels the second liquid from the lower reservoir to the upper reservoir based on the rate from the flow sensor.

12. The visual art piece of claim 1, further comprising:

a display panel to display an indication of at least one of a time or a temperature;

a speaker to emit sounds corresponding to the natural scene; and a light to illuminate at least a portion of the natural scene.

13. A system comprising:

a sealed environment comprising an upper reservoir, a lower reservoir and a channel between the lower reservoir and the upper reservoir, wherein the sealed environment is filled with a first liquid and a second liquid, wherein the first liquid and the second liquid are immiscible, wherein the second liquid has a higher density than the first liquid, wherein the first liquid is substantially transparent and wherein the second liquid is more opaque than the first liquid, wherein a viscosity of the second liquid is higher than a viscosity of the first liquid, wherein the second liquid comprises a plurality of solid particles mixed throughout, wherein the plurality of solid particles are not individually visible to the naked eye, the plurality of solid particles to prevent the viscosity of the second liquid from decreasing over time when the second liquid is agitated; and a pump coupled to the lower reservoir, the pump to propel the second liquid from the lower reservoir to the upper reservoir through the channel when activated, the second liquid to flow through the first liquid in the upper reservoir to the lower reservoir.

14. The system of claim 13, wherein a difference between a surface tension of the first liquid and a surface tension of the second liquid is approximately 10 to 25 milliNewtons/meter at 25° Celsius against air.

* * * * *